US008534668B2

(12) United States Patent
Iino et al.

(10) Patent No.: US 8,534,668 B2
(45) Date of Patent: Sep. 17, 2013

(54) IMAGE FORMING DEVICE

(75) Inventors: Hikaru Iino, Nagoya (JP); Hiroshi Nobe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/247,547

(22) Filed: Sep. 28, 2011

(65) Prior Publication Data

US 2012/0104675 A1 May 3, 2012

(30) Foreign Application Priority Data

Oct. 29, 2010 (JP) ..... 2010-244126

(51) Int. Cl.
*B65H 9/16* (2006.01)

(52) U.S. Cl.
USPC ..... 271/251; 271/186

(58) Field of Classification Search
USPC ..... 271/250–252, 301, 186
See application file for complete search history.

(56) References Cited

U.S. PATENT DOCUMENTS

| | | | | |
|---|---|---|---|---|
| 6,837,635 | B1 * | 1/2005 | Juan | 400/636 |
| 7,658,379 | B2 * | 2/2010 | Yasumoto | 271/251 |
| 7,810,809 | B2 * | 10/2010 | Inui | 271/250 |

FOREIGN PATENT DOCUMENTS

| | | | |
|---|---|---|---|
| JP | S61-056349 | U | 4/1986 |
| JP | H11-035188 | A | 2/1999 |
| JP | 2000-219378 | A | 8/2000 |
| JP | 2001-335181 | A | 12/2001 |
| JP | 2002-104694 | A | 4/2002 |
| JP | 2003-095475 | A | 4/2003 |
| JP | 3466907 | B2 | 11/2003 |

* cited by examiner

*Primary Examiner* — Michael McCullough
(74) *Attorney, Agent, or Firm* — Baker Botts L.L.P.

(57) ABSTRACT

An image forming device includes a sheet container unit that stores a plurality of sheets, an image forming unit that forms an image on a particular surface of a sheet that is conveyed from the sheet container unit, and a re-conveying unit that re-conveys the sheet to the image forming unit. The re-conveying unit includes a conveyor roller set that conveys the sheet. The conveyor roller set includes a pinch roller and a driving roller that receives a driving force and that contacts the particular surface of the sheet. The driving roller has a greater coefficient of friction than the pinch roller.

20 Claims, 4 Drawing Sheets

IMAGE FORMING DEVICE

CROSS-REFERENCE TO RELATED APPLICATION

This application claims priority to Japanese Patent Application No. 2010-244126, filed on Oct. 29, 2010, the entire subject matter and disclosure of which is incorporated herein by reference.

BACKGROUND OF THE INVENTION

1. Field of the Invention

The invention relates to an image forming device that performs single-sided and double-sided printing.

2. Description of the Related Art

A known image forming device includes a re-conveying means for returning an inverted paper sheet with an image formed on a first surface thereof to an image forming unit. A known image forming device, e.g., the image forming device described in Japanese Unexamined Patent Application Publication No. 2002-104694, includes conveyor rollers for conveying the paper sheet obliquely toward a one-side regulation member provided at one width direction end of the paper sheet. In a known image forming device, conveyor rollers have a driving roller, a pinch roller which is obliquely inclined with respect to the driving roller, and a spring which urges the pinch roller toward the driving roller.

In the known image forming device, the conveyor rollers include a rubber-made driving roller and a resin-made pinch roller which follows the driving roller. The pinch roller is disposed obliquely to the driving roller so as to obliquely convey the paper sheet. The pinch roller is disposed in contact with the first surface on which an image has been formed, i.e., a printed surface.

SUMMARY OF EMBODIMENTS OF INVENTION

In a known image forming device, however, if a resin-made pinch roller is disposed in contact with the printed surface of the paper sheet, the pinch roller may slip against the printed surface. As a result, the oblique feeding capability of the pinch roller may be reduced. This problem is especially likely to occur when glossy paper is used and when color printing is performed in which multiple colors are superimposed on top of one another.

Therefore, a need has arisen for systems and methods for an image forming apparatus, and it is an object of the invention to overcome these and other deficiencies of the prior art. Specifically, in an embodiment of the invention, the pinch roller may be disposed to contact a non-printed surface of the recording sheet, such that the pinch roller rotates without sliding on the recording sheet. Thus, the recording sheet may reliably be conveyed obliquely by the rotation of the pinch roller. Further, the driving roller, which may have a coefficient of friction (i.e., a coefficient of friction with respect to the recording sheet) greater than the pinch roller, may be disposed to contact the printed surface of the recording sheet, and the recording sheet may reliably be conveyed by the driving roller.

In an embodiment of the invention, an image forming device comprises: a sheet container unit configured to store a plurality of sheets; an image forming unit configured to form an image on a particular surface of a sheet that is conveyed from the sheet container unit; and a re-conveying unit configured to re-convey the sheet to the image forming unit, wherein the re-conveying unit comprises: a conveyor roller set configured to convey the sheet, wherein the conveyor roller set comprises: a pinch roller; and a driving roller configured to receive a driving force and to contact the particular surface of the sheet, wherein the driving roller has a greater coefficient of friction than the pinch roller.

In another embodiment of the invention, an image forming device comprises: a sheet container unit configured to store a plurality of sheets; an image forming unit configured to form an image on a particular surface of a sheet that is conveyed from the sheet container unit; and a conveyor roller set configured to convey the sheet on a re-conveying path, wherein the conveyor roller set comprises: a driving roller disposed above the re-conveying path and configured to receive a driving force, and a pinch roller disposed below the re-conveying path, wherein the driving roller has a greater coefficient of friction than the pinch roller.

In yet another embodiment of the invention, an image forming device comprises: a sheet container unit configured to store a plurality of sheets; an image forming unit configured to form an image on a particular surface of a sheet that is conveyed from the sheet container unit; and a conveyor roller set configured to convey the sheet on a conveying path, wherein the conveyor roller set comprises: a driving roller configured to receive a driving force, and a pinch roller disposed further from the image forming unit than the driving roller, wherein the driving roller has a greater coefficient of friction than the pinch roller.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-4, like numerals being used for like corresponding portions in the various drawings.

Figure 1:
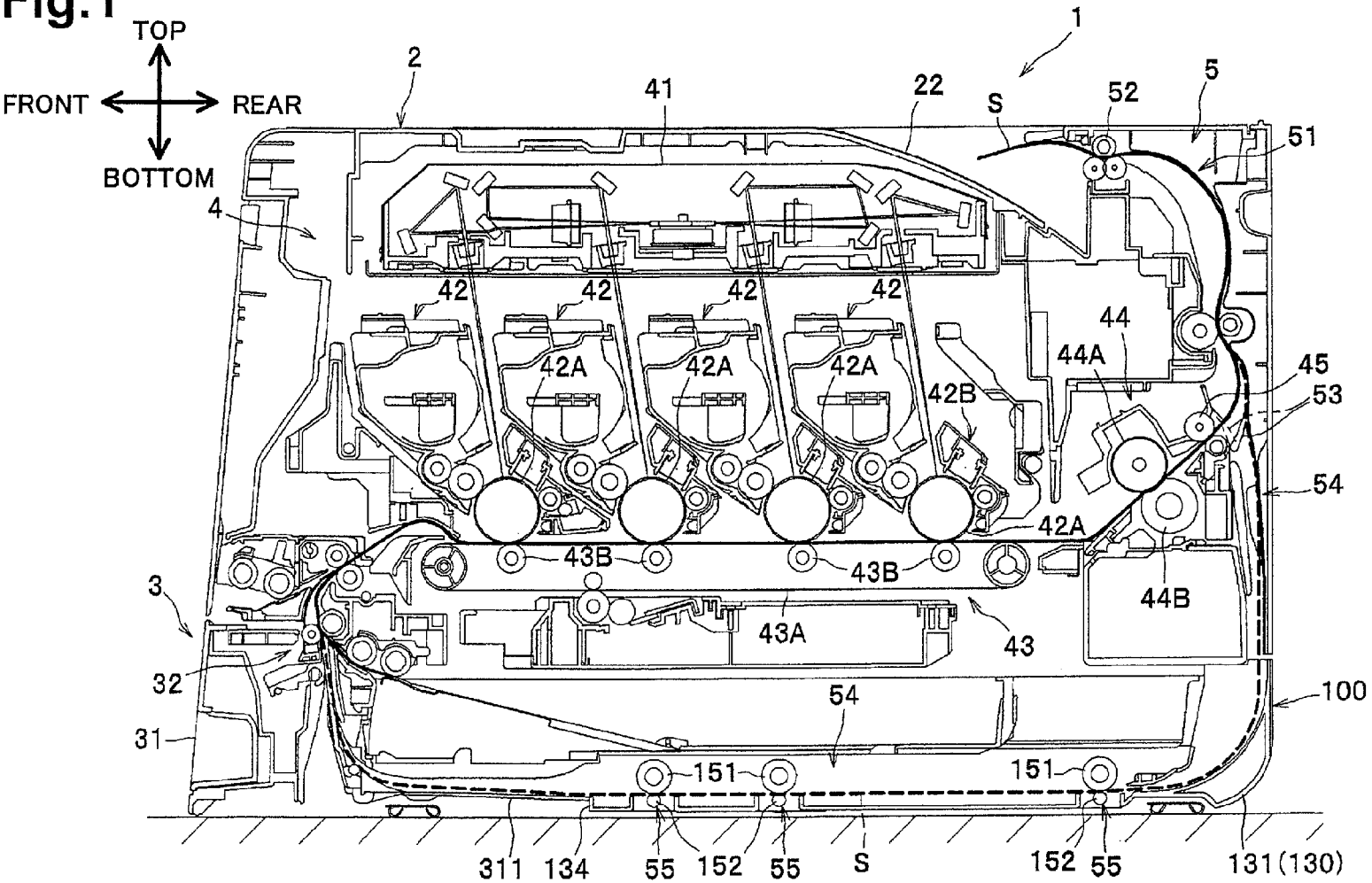
FIG. 1 depicts a side cutaway view of an image forming device, e.g., a color printer, according to an embodiment of the invention.

Hereinafter, an embodiment of the present invention will be described in detail with reference to FIG. 1, which depicts a structure of an image forming device, e.g., color printer 1, according to an embodiment of the invention. Color printer 1 may comprise a re-conveying unit 100, which will be described in more detail herein with respect to FIGS. 2-4. In the following descriptions, directions may defined with reference to a user who is using the color printer 1. Specifically, when oriented as depicted in FIG. 1, the left side of the page may be a "front side," hereinafter interchangeably referred to as a "near side," e.g., "nearer" to the user than the opposite side. The right side of the page may be a "rear side," hereinafter interchangeably referred to as a "back side." Similarly, the back side of the page, e.g., the side that cannot be seen, may be a "left side," and the near, visible side of the page may be a "right side," of the color printer 1. The vertical direction of the page of FIG. 1 may be referred to as a "vertical direction" with reference to the color printer 1.

As depicted in FIG. 1, the color printer 1 may be an apparatus that forms images on both surfaces of a recording sheet, e.g., a paper sheet S. The color printer 1 may comprise a paper feeding unit 3, an image forming unit 4, and a conveying unit 5, which may be disposed in an apparatus main body 2. The paper feeding unit 3, which may be disposed at a lower portion of the apparatus main body 2, may comprise a paper feed tray 31, e.g., a sheet container unit configured to accommodate, e.g., to store, a plurality of sheets, including a paper sheet S, and a paper feeding mechanism 32. The paper feeding mechanism 32 may feed the paper sheet S from the paper feed tray 31 to the image forming unit 4. The paper feed tray 31 may be removed from the apparatus main body 2 by exerting a force pulling the paper feed tray 31 away from the apparatus main body 2, and the paper feed tray 31 may be replaced into the apparatus main body by exerting a force pushing the paper feed tray 31 into the apparatus main body 31.

The image forming unit 4 for forming an image on the paper sheet S conveyed from the paper feeding unit 3 may comprise an exposure unit 41, four process units 42, a transfer unit 43 and a fixing unit 44. The exposure unit 41 may be disposed at an upper portion of the apparatus main body 2. The exposure unit 41 may comprise a laser light source (not depicted), a polygon mirror, a plurality of lenses and a plurality of reflectors. With reference to FIG. 1, the polygon mirror, plurality of lenses, and plurality of reflectors are not assigned reference numerals. The laser light source may emit laser light that corresponds to image data. The emitted laser light may be reflected by the polygon mirrors and the reflectors, such that the laser light may pass through the lenses and then rapidly scan a surface of each of photosensitive drums 42A.

The process units 42 may be disposed serially in a direction from the front side of the color printer 1 to the rear side of the color printer 1, hereinafter interchangeably referred to as a front-to-rear direction, and disposed between the paper feed tray 31 and the exposure unit 41. Each process unit 42 may comprise a photosensitive drum 42A, a charging unit 42B, a developing roller, a supply roller, a layer-thickness regulating blade and a toner container unit which accommodates toner, e.g., a developing agent. With reference to FIG. 1, the developing roller, supply roller, layer-thickness regulating blade, and toner container unit are not assigned reference numerals. Each process unit 42 may be substantially the same in structure, except that, in an embodiment of the invention, each process unit 42 may accommodate a different color of toner in the toner container unit.

The transfer unit 43 may be disposed between the paper feed tray 31 and the process units 42. The transfer unit 43 may comprise an endless conveyor belt 43A stretched between a driving roller and a driven roller, which are not assigned reference numerals in FIG. 1, and four transfer rollers 43B. An outer surface of the conveyor belt 43A may be in contact with the photosensitive drums 42A. The conveyor belt 43A may be held between each of the transfer rollers 43B, which may be disposed inside the conveyor belt 43A, and each of the photosensitive drums 42A.

The fixing unit 44 may be disposed behind the process units 42. The fixing unit 44 may comprise a heat roller 44A and a pressure roller 44B disposed opposite to the heat roller 44A to press the heat roller 44A. In the image forming unit 4, the charging unit 42B may uniformly charge the surface of each of the photosensitive drums 42A. Then, the exposure unit 41 may emit laser light that exposes each of the photosensitive drums 42A to the emitted laser light. As a result, an electrostatic latent image corresponding to the image data may be formed on each of the photosensitive drums 42A. A supply roller may supply the toner in the toner container unit to the developing roller. The supplied toner in the developing roller may enter between the developing roller and the layer-thickness regulating blade, and may form a thin toner layer of fixed thickness that is supported on the developing roller.

The toner supported on the developing roller then may be supplied to each of the photosensitive drums 42A on which the electrostatic latent image is formed. Then, the electrostatic latent image may be visualized and a toner image may be formed on each of the photosensitive drums 42A. Then, the paper sheet S may be fed from the paper feeding unit 3 and may be conveyed between the photosensitive drums 42A and the conveyor belt 43A. After that, the toner images formed on the photosensitive drums 42A may be sequentially transferred to the paper sheet S to be superimposed on top of one another.

The paper sheet S on which the toner images have been transferred then may be conveyed between the heat roller 44A and the pressure roller 44B for the heat-fusing of the toner images. In this manner, an image may be formed on a particular surface, e.g., a first side or a particular side of the paper sheet S. The paper sheet S on which the image has been formed may be output to a conveying path 51 from the fixing unit 44 by an output roller 45.

The conveying unit 5 may function as an output mechanism for outputting the paper sheet S from the image forming unit 4 to the outside of the apparatus main body 2 and, at the same time, may function as a re-conveying unit for re-conveying, to the image forming unit 4, the inverted paper sheet S with the image formed on the first surface thereof by the image forming unit 4. Specifically, the conveying unit 5 may comprise a conveying path 51, an output roller 52, a flapper 53 which may swing in the front-to-rear direction, a re-conveying path 54 and a plurality of conveyor rollers 55 that may convey the paper sheet S in the re-conveying path 54.

The conveying path 51 may be at the rear portion of the apparatus main body 2. The conveying path 51 may extend upward from a portion near the front side of a backwardly swung flapper 53, e.g., as depicted by the solid line in FIG. 1, and then may extend and curve to the front.

The output roller 52 may selectively rotate in both a forward and a reverse direction. When the output roller 52 is rotating in a forward direction, the paper sheet S may be outputted from the image forming unit 4 to the outside of the apparatus main body 2. When the output roller 52 is rotated in the reverse direction, the paper sheet S may be conveyed into the apparatus main body 2.

The re-conveying path 54 may extend from the rear portion of the apparatus main body 2 to the lower portion of the apparatus main body 2, as depicted in FIG. 1. The re-conveying path 54 may extend downward from a portion near the rear side of the forwardly swung flapper 53, e.g. as depicted by the dashed line in FIG. 1, and then may extend to the front below the paper feed tray 31 to curve to the front. The re-conveying path 54 then may extend to curve upward toward the paper feeding mechanism 32. Re-conveying unit 100, which will be described in more detail herein, may form at least a portion of the re-conveying path 54.

Figure 2:
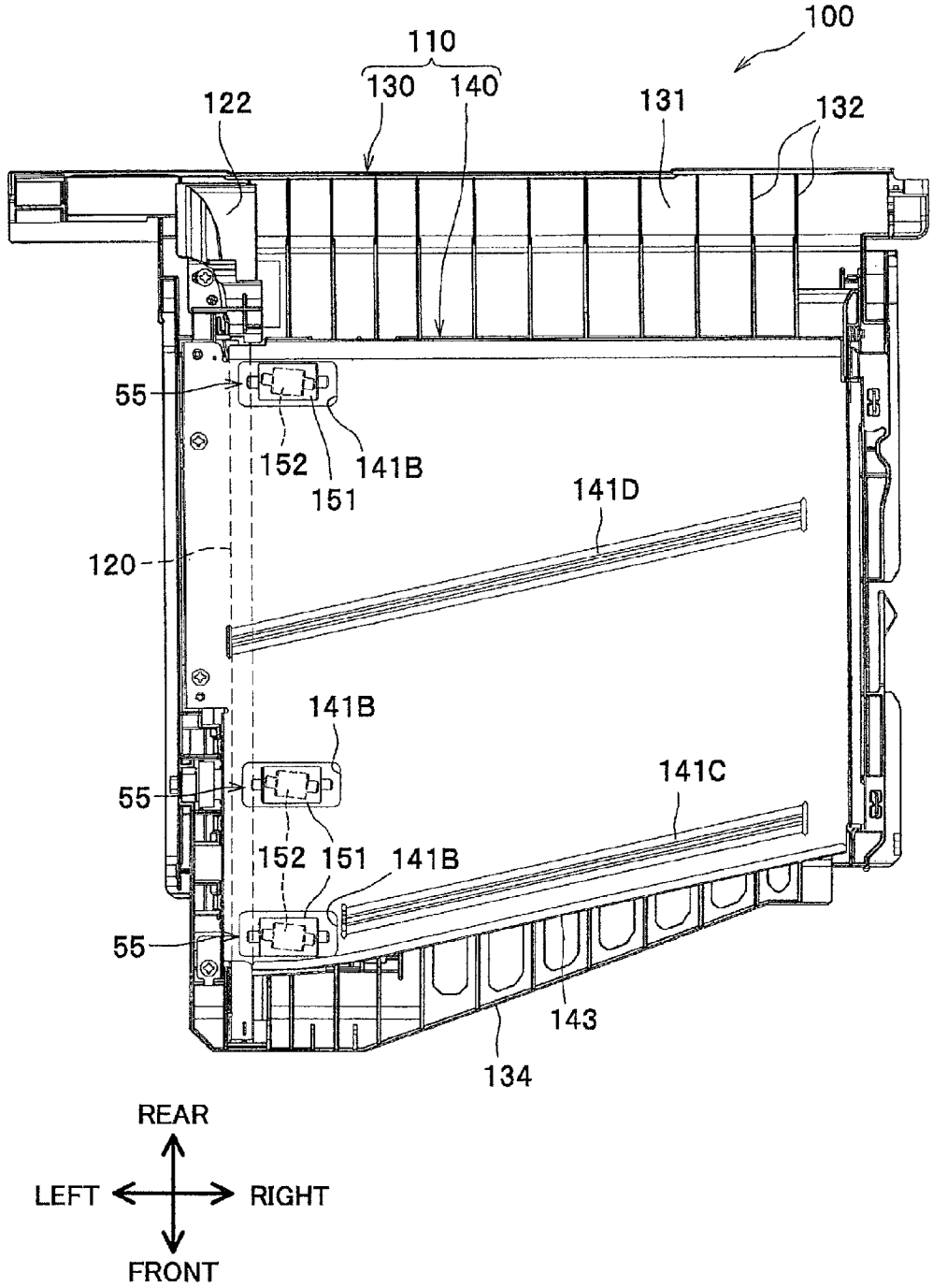
FIG. 2 is a perspective view of a re-conveying unit, according to an embodiment of the invention.

FIG. 2 depicts a re-conveying unit 100 according to an embodiment of the invention. Re-conveying unit 100 may be disposed below the paper feed tray 31. Re-conveying unit 100 may form a portion extending in the front-to-rear direction, e.g., a rear portion, of the re-conveying path 54. The re-conveying unit 100 may have a substantially flat plate shape, as depicted in FIG. 2. The re-conveying unit 100 may be fixed to the apparatus main body 2, and the paper feed tray 31 may be removably mounted to the re-conveying unit 100. The re-conveying unit 100 may comprise a guide member 110, a single-side regulation member 120, and two or more pairs of conveyor rollers 55. Specifically, one pair of conveyor rollers 55 may comprise a driving roller 151 and a pinch roller 152. In addition, there may be additional pairs, e.g., one or more pairs of conveyor rollers 55 that also convey the sheet therebetween. Each of these sets may comprise a further driving roller that receives the driving force and contacts the particular surface of the sheet, and a further pinch roller.

The guide member 110 may comprise a lower conveyance member 130 and an upper conveyance guide 140. The lower conveyance member 130 may be disposed below the paper sheet S and the upper conveyance guide 140 may be disposed above the paper sheet S, which may pass along the re-conveying path 54. The lower conveyance member 130 may comprise a resin, and has a width greater than the width of the paper sheet S, e.g., the length of the paper sheet S in the left-to-right direction. The lower conveyance member 130 may comprise a bottom wall portion 131, guide ribs 132, and a downstream end portion 134.

The bottom wall portion 131 may be substantially plate-shaped in its entirety, and a rear end portion thereof may be formed in an arc shape when viewed in a sectional view. The guide ribs 132 may project inwardly from the bottom wall portion 131 and may extend along the conveying direction of the paper sheet S. Each of the guide ribs 132 may be spaced from each other along the width direction of the paper sheet S.

The downstream end portion 134 may be formed to incline toward the rear side, e.g., the upstream side of the conveying direction of the paper sheet S from the left side to the right side. Thus, the entire leading end of the paper sheet S may be prevented from being caught in a joint of the lower conveyance member 130 and a downstream path forming portion 311, which will be described in more detail herein, with reference to FIG. 3.

The upper conveyance guide 140 may be formed from a metal sheet and may have a size that is greater than the width of the paper sheet S. Each end portions of upper conveyance guide 140 may be bent downward at respective left-to-right direction ends and may be fixed to or supported by the lower conveyance guide 130. Thus, because the upper conveyance guide 140 may be supported by the lower conveyance member 130 at both ends, deformation of the upper conveyance guide 140 may be reduced or prevented, even if an urging force is applied to the upper conveyance guide 140.

Escape holes 141B for may be formed at a left side of upper conveyance guide 140. Escape holes 141B may be configured to let pinch roller 152, which will be described later, to contact with the driving roller 151. A downstream end portion 143 of the upper conveyance guide 140 may incline toward the rear side, e.g., the upstream side of the conveying direction of the paper sheet S, from the left side to the right side.

With this configuration, in the event of a paper jam in conveyance roller 55, which may be disposed on the left side of the downstream end portion 143, a right corner of the paper sheet S may project further forward than the downstream end portion 143 does because the right side may be opened by the inclination of the downstream end portion 143. Thus, when the paper feed tray 31 is removed to expose the front end of the re-conveying unit 100, the right corner of the paper sheet S projecting from the downstream end portion 143 may be located easily, and the paper sheet S may be easily drawn out by the right corner.

Two reinforcing ribs 141C and 141D may be disposed in the upper conveyance guide 140 to extend from one end to the other end in the left-to-right direction, which may further reduce or prevent deformation of the upper conveyance guide 140. Specifically, the reinforcing rib 141C may project upward at a position near the downstream end portion 143 of the upper wall portion 141. The reinforcing rib 141C may extend from a position slightly spaced to the right, apart from the escape holes 141B at the left end of upper wall portion 141, to a position near a right end of the upper wall portion 141. The reinforcing rib 141D may project upward at a substantially center position of the upper wall portion 141 in the front-to-rear direction. Reinforcing rib 141D may extend from a position near the right end of the upper wall portion 141 to a position over the escape holes 141B in the left-to-right direction. Thus, deformation of the upper conveyance guide 140 may be further reduced or prevented by the reinforcing rib 141D, which may be longer than the reinforcing rib 141C.

The reinforcing ribs 141C and 141D may incline toward the rear side. Thus, the entire leading end of the paper sheet S may be prevented from being caught by the reinforcing ribs 141C and 141D. Additionally, if the leading end of the paper sheet S comes into contact with each of the reinforcing ribs 141C and 141D formed in an inclined manner, the paper sheet S may be obliquely fed along the reinforcing ribs 141C and 141D.

The single-side regulation member 120 may contact with a left end of the paper sheet S, and may regulate a position of the paper sheet S in the width direction. The single-side regulation member 120 may be formed in an elongated shape extending in the front-to-rear direction, e.g., the particular direction, and may be disposed on the left side of the lower conveyance guide 130. A guide 122 may be disposed at a rear end portion 121 of the single-side regulation member 120. The guide 122 may guide a left end of the paper sheet S toward the right side surface, e.g., a guide surface of the single-side regulation member 120 when the paper sheet S is conveyed with the left end thereof protruding to the left across the right side surface of the single-side regulation member 120.

The conveyor rollers 55 may convey the paper sheet S obliquely in the conveying direction, such that the left end of the paper sheet S may be in contact with the single-side regulation member 120. The conveyor rollers 55 may be disposed at positions closer to the single-side regulation member 120 in the left-to-right direction than to a center of the re-conveying unit 100 in the left-to-right direction, e.g., the direction perpendicular to the particular direction. The set of conveyor rollers 55 may comprise three pairs of conveyance rollers 55. Each pair of the conveyance rollers 55 may comprise rollers disposed in the vertical direction. The three pairs of conveyance rollers 55 may be arranged such that they spaced apart from one another at predetermined intervals in the conveying direction.

Each pair of the conveyor rollers 55 may comprise a driving roller 151 comprising rubber material and a pinch roller 152 comprising a plastic material, e.g. a material that is harder and has less adhesive properties than, e.g., rubber material. The driving roller 151 may receive a driving force transmitted from a driving source, e.g., a motor (not depicted). The pinch roller 152 may incline with respect to a central axis of the driving roller 151 in the left-right direction, such that the pinch roller 152 may convey the paper sheet S obliquely.

Specifically, the pinch roller 152 may be disposed at an angle, e.g., a particular angle, relative to the driving roller in the left-to-right direction, e.g., a direction perpendicular to the particular direction. With respect to the re-conveying path 54, pinch roller 152 may be disposed below the re-conveying path 54, and driving roller 151 may be disposed above the re-conveying path 54. In another embodiment of the invention, the pinch roller 152 and the driving roller 151 may not be disposed at an angle, and pinch roller 152 may not be disposed obliquely to driving roller 151.

As illustrated in FIG. 1, the driving roller 151 may be rotatably supported by the apparatus main bodies 2, e.g., a bracket fixed to the upper conveyance guide 140. The driving roller 151 may be disposed above the pinch roller 152. The driving roller 151 may contact the particular surface, e.g., a printed surface, of the paper sheet S. The pinch roller 152 may be disposed further away from the image forming unit 4 than the driving roller 151. In addition, the pinch roller 152 may be disposed further away from the sheet container unit 5 than the driving roller 151.

A conveyance surface of the driving roller 151 may comprise rubber, which is a material with a greater coefficient of friction than a resin conveyance surface of pinch roller 152. The "coefficient of friction" referred to in this application may be understood as the coefficient of friction of the surface relative to the paper sheet S.

With this configuration, sliding of the driving roller 151 on the printing surface of the paper sheet S may be prevented and the driving roller 151 may convey the paper sheet S reliably. The pinch roller 152 with a lower coefficient of friction may be in contact with a non-printed surface, e.g., a surface on which no image has been formed, of paper sheet S. The pinch roller 152 may be driven to rotate without sliding on the paper sheet S conveyed by the driving roller 151. Thus, the paper sheet S may reliably be conveyed obliquely by the rotation of the pinch roller 152.

The pinch roller 152 may comprise a resin-made conveyance surface and may be rotatably supported by the lower conveyance guide 130. In particular, the pinch roller 152 may be supported by the lower conveyance member 130 to be rotatable and slidable in the vertical direction. The pinch roller 152 may be urged upward by an urging member, e.g., a torsion spring, fixed to the lower conveyance guide 130. With this configuration, the pinch roller 152 may be urged toward the driving roller 151 by the urging member to be in contact with the driving roller 151.

The pinch roller 152 may comprise a resin, which may be a material with a coefficient of friction less than that of the driving roller 151. Thus, the pinch roller 152 may slide on the non-printed surface and the paper sheet S may be fed in a straight line in the conveying direction by the driving roller 151 after the paper sheet S comes in contact with the one-side regulation member 120. With this configuration, folding of the end of the paper sheet S caused by the paper sheet S moving too close to the one-side regulation member 120 may be prevented.

The conveyance rollers 55, which may be disposed the furthest downstream in the conveying direction, may be positioned within the inclination of the downstream end portion 143 of the upper conveyance guide 140 described above, e.g., the position which overlaps the inclination of the downstream end portion 143 in the width direction. Thus, the paper sheet S may be easily drawn from the right side of the inclined portion even if, for example, a paper jam occurs in a state in which the paper sheet S is caught in the conveyance rollers 55.

The downstream end portion 143 of the upper conveyance guide 140 may be shorter than the downstream end portion 134 of the lower conveyance member 130 in the sheet conveying direction. Thus, the downstream end portion 143 of the upper conveyance guide 140 may be disposed further upstream than the downstream end portion 134 of the lower conveyance member 130 in the sheet conveying direction.

Figure 3:
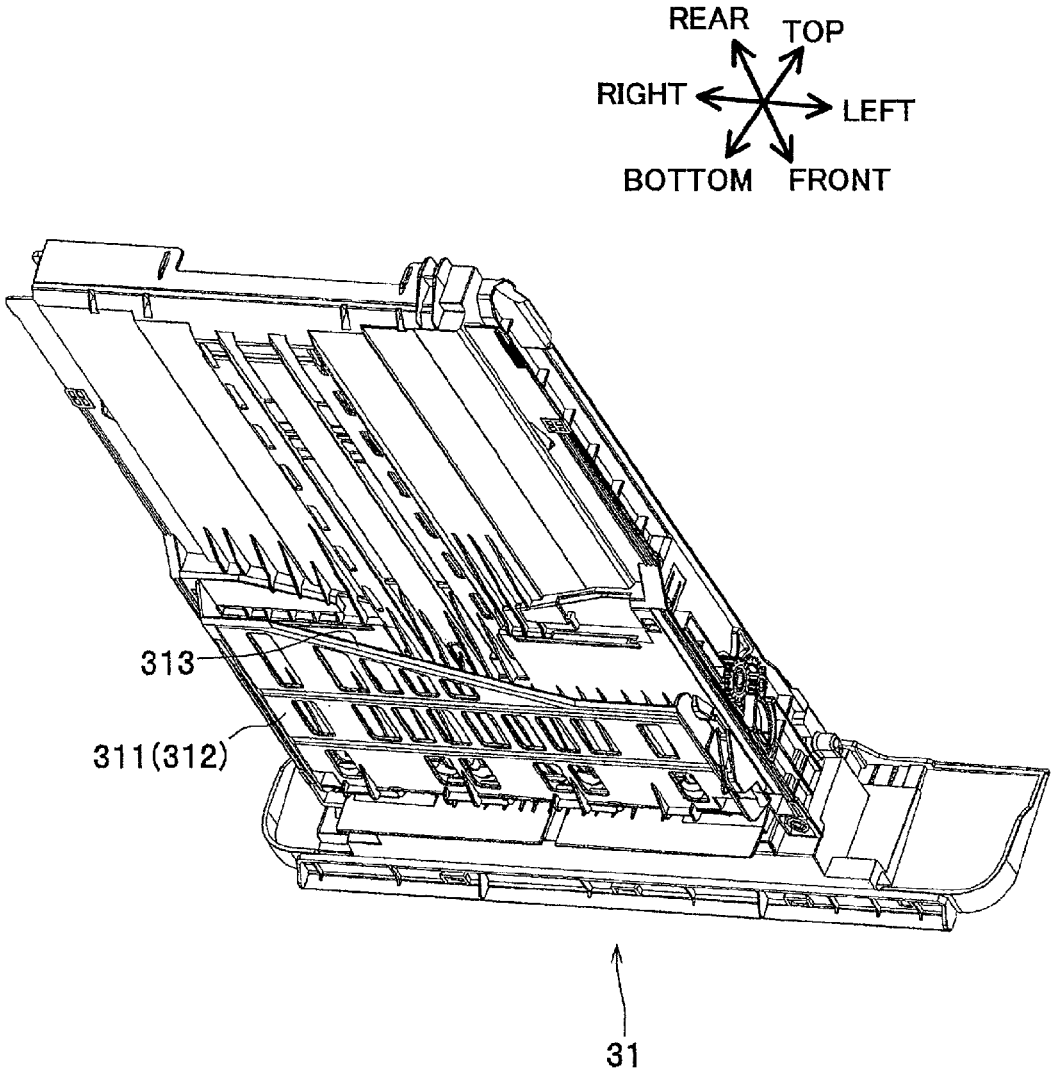
FIG. 3 is a bottom perspective view of a paper feed tray, according to an embodiment of the invention.

As shown in FIG. 3, a downstream path forming portion 311 may be disposed in the lower front portion of the paper feed tray 31. The downstream path forming portion 311 may comprise a path on which the paper sheet S fed from the guide member 110 of the re-conveying path 100 is conveyed. The downstream path forming portion 311 may be a portion of the conveying unit 5, e.g., which may form a front portion of the section of the re-conveying path 54 extending in the front-rear direction, as depicted in FIG. 1. The downstream end portion 134 of the re-conveying unit 100 may be connected to the downstream path forming portion 311.

Specifically, an upstream end portion 313 of a lower forming portion 312 that forms a lower portion of the downstream path forming portion 311 may have a shape that conforms to the downstream end portion 134 of the lower conveyance guide 130. Because the paper feed tray 31 may be removably mounted to the apparatus main body 2, the downstream path forming portion 311 may be removably mounted to the re-conveying unit 100 of the apparatus main body 2.

Figure 4:
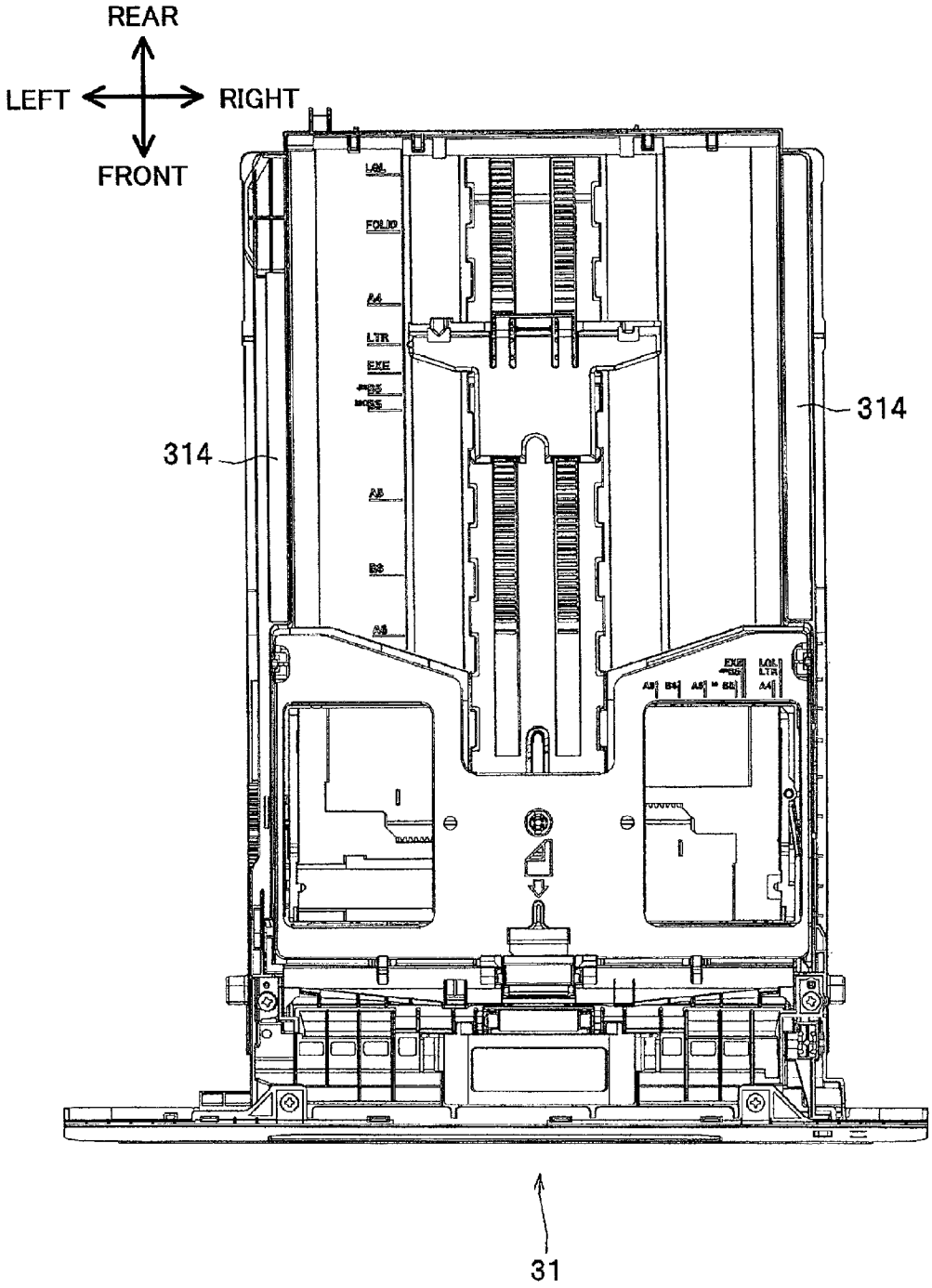
FIG. 4 is a top perspective view of a paper feed tray, according to an embodiment of the invention.

As depicted in FIG. 4, a pair of both-side regulation members 314 may be disposed in the paper feed tray 31. Each of the pair of both-side regulation members 314 may contact with respective width direction ends of the paper sheet S, and may regulate the position of the paper sheet S in the width direction. With this configuration, for the printing on the first surface of the paper sheet S, both the right and left ends of the paper sheet S may contact with each both-side regulation members 314. Thus, the paper sheet S may be positioned in the width direction; and, for the printing on the second surface of the paper sheet S, the left end of the paper sheet S may contact with the single-side regulation member 120, which may position the paper sheet S in the width direction.

In an embodiment of the invention, because the pinch roller 152 is reliably driven to rotate on the paper sheet S by letting the pinch rollers 152 be in contact with the non-printing surface of the paper sheet S, oblique feeding capability of the conveyor rollers 55 may be improved.

In an embodiment of the invention, because the conveyance surface of the driving roller 151 is made of rubber, sliding on the printing surface of the paper sheet S may be prevented. Because the conveyance surface of the pinch rollers 152 is made of resin, the pinch rollers 152 may slide reliably with respect to the paper sheet S after the paper sheet S comes into contact with the one-side regulation member 120, and thus folding of an end of the paper sheet S may be prevented.

In an embodiment of the invention, because the conveyor rollers 55 are disposed at positions nearer the one-side regulation member 120 in the left-right direction, bending of the paper sheet S between the conveyor rollers 55 and the one-side regulation member 120 may be prevented.

In an embodiment of the invention, because the downstream end portion 134 of the lower conveyance member 130 is formed to incline toward the rear side from the left to the right side, the entire leading end of the paper sheet S may be prevented from being caught by the joint of the lower conveyance member 130 and the downstream path forming portion 311. Because the lower conveyance member 130 is formed to incline similarly to the upper conveyance guide 140, the right corner of the paper sheet S may project from each of the downstream end portions 143 and 134 when the paper feed tray 31 is removed, thus providing a space for a user's fingers above and below the corner of the paper sheet S, thereby allowing a user to hold the corner of the paper sheet S from above and below with the fingers to thereby clear the jammed paper sheet S.

In an embodiment of the invention, the upper conveyance guide 140 may be formed from a metal sheet. In addition, the upper conveyance guide 140 may have a reduced thickness in the vertical direction and increased rigidity. Thus, the apparatus main body 2 may be compact in the vertical direction and, at the same time, deformation of the upper conveyance guide 140 may be further reduced or prevented.

In the above-described embodiments of the invention, the pinch roller 152 may comprise a resin and the driving roller 151 may comprise a rubber. Nevertheless, the invention is not limited to this configuration. In other embodiments of the invention, the rollers may be made of any materials and configured in any manner such that the driving roller has a coefficient of friction which is greater than that of the pinch roller.

In the above-described embodiments of the invention, three pairs of the conveyance rollers 55 may be provided in the above-described embodiment. Nevertheless, in other embodiments of the invention, the number of the pairs of the conveyance rollers 55 may be one, or two or more.

Although the paper feed tray 31 which is removably mounted to the apparatus main body 2 is used as a recording sheet container unit in the above-described embodiment, the present invention is not limited to the same. For example, the recording sheet container unit may be a paper feed tray which is merely movable with respect to the apparatus main body and thus is not removable from the apparatus main body (i.e., the recording sheet container unit is not removed from the apparatus main body 2 unless a tool, such as a screwdriver, is used). Alternatively, the recording sheet container may be formed integrally with the apparatus main body at a lower portion of the apparatus main body.

In the above-described embodiments of the invention, the paper feed tray 31 may be removably mounted to the apparatus main body 2, and may be used as a recording sheet container unit. In other embodiments, however, the recording sheet container unit may be a paper feed tray which is merely movable with respect to the apparatus main body and thus is not removable from the apparatus main body. In still other embodiments, the recording sheet container unit may be removed from the apparatus main body 2 only by using a tool, e.g., a screwdriver. In yet other embodiments of the invention, the recording sheet container may be formed integrally with the apparatus main body at a lower portion of the apparatus main body. In further embodiments of the invention, the downstream path forming portion may be formed integrally with the apparatus main body, and the guide member may be removably mounted to the downstream path forming portion of the apparatus main body.

In the above-described embodiments, the image forming unit 4 may comprise the exposure unit 41. Nevertheless, in other embodiments, an LED head may be used instead of the exposure unit 41, a belt-like photoconductor may be used instead of the photosensitive drum 42A, and a cylindrical-shaped fixing film slidably supported by a guide may be used instead of the heat roller 44A. Other components, e.g., a conductive brush and a conductive plate spring, to which transfer bias is applied may be used instead of the transfer roller 43B.

Although the above-described embodiments refer to a color printer 1 for convenience, the invention is not limited to the same. For example, embodiments of the invention may be applied to a monochrome printer and any other image forming device, e.g., a copying machine and a multi-function device.

In the above-described embodiments of the invention, the re-conveyed paper sheet S is conveyed below the paper feed tray 31. Nevertheless, in other embodiments, for example, the re-conveyed paper sheet may be conveyed above the paper feed tray.

In the above-described embodiments of the invention, the re-conveying unit 100 may be disposed below the paper feed tray 31, however, in other embodiments, the re-conveying unit 100 may be disposed above the paper feed tray 31. In addition, in the above-described embodiments, the upper conveyance guide 140 may be formed from a metal sheet, however, in other embodiments, the upper conveyance guide may be formed of any other suitable material, e.g., a resin. In an embodiment of the invention, If the upper conveyance guide is made of resin, the upper conveyance guide and the roller holder may be formed integrally with each other.

Although the paper feed tray 31 (i.e., the downstream path forming portion 311) may be removably mounted to the apparatus main body 2 in the above-described embodiment, the present invention is not limited to the same; for example, the downstream path forming portion may be formed integrally with the apparatus main body and the guide member may be removably mounted to the downstream path forming portion (i.e., the apparatus main body). Although the re-conveying unit 100 may be disposed below the paper feed tray 31 in the above-described embodiment, the present invention is not limited to the same; for example, the re-conveying unit 100 may be disposed above the paper feed tray 31.

While the invention has been described in connection with the above embodiments, it will be understood by those of ordinary skill in the art that other variations and modifications of the preferred embodiments described above may be made without departing from the scope of the invention. Other embodiments will be apparent to those of ordinary skill in the art from a consideration of the specification or practice of the invention disclosed herein. The specification and the described examples are considered as exemplary only, with the true scope and spirit of the invention indicated by the following claims.

What is claimed is:

1. An image forming device comprising:

a sheet container unit configured to store a plurality of sheets;

an image forming unit configured to form an image on a particular surface of a sheet that is conveyed from the sheet container unit; and a re-conveying unit configured to re-convey the sheet with the image formed on the particular surface to the image forming unit in a conveying direction, wherein the re-conveying unit comprises:

a conveyor roller set configured to convey the sheet, wherein the conveyor roller set comprises:

a pinch roller; and a driving roller configured to receive a driving force and to contact the particular surface of the sheet, wherein the driving roller has a greater coefficient of friction than the pinch roller; and a particular conveyance member configured to support the pinch roller, wherein the particular conveyance member comprises:

a guide rib extending along the conveying direction; and a downstream end portion disposed at a downstream end of the particular conveyance member in the conveying direction, the downstream end portion inclined in a width direction perpendicular to the conveying direction.

2. The image forming device according to claim 1, wherein:

the re-conveying unit further comprises a single regulation member extending in a particular direction and configured to contact a particular end of the sheet to regulate a position of the sheet, and the pinch roller is disposed at a particular angle relative to the driving roller in a direction perpendicular to the particular direction.

3. The image forming device according to claim 2, wherein the conveyor roller set is disposed closer to the single side regulation member than to a center of the re-conveying unit in the direction perpendicular to the particular direction.

4. The image forming device according to claim 1, wherein the driving roller comprises rubber and the pinch roller comprises plastic material.

5. The image forming device according to claim 1, wherein the pinch roller is disposed further from the sheet container unit than the driving roller.

6. The image forming device according to claim 1, wherein the re-conveying unit further comprises a plurality of further conveyor roller sets configured to convey the sheet therebetween, wherein each of the plurality of the further conveyor roller sets comprises:

a further driving roller configured to receive the driving force and to contact the particular surface of the sheet, and a further pinch roller.

7. An image forming device comprising:

a sheet container unit configured to store a plurality of sheets;

an image forming unit configured to form an image on a particular surface of a sheet that is conveyed from the sheet container unit;

a conveyor roller set configured to convey the sheet with the image formed on the particular surface on a re-conveying path in a conveying direction, wherein the conveyor roller set comprises:

a driving roller disposed above the re-conveying path and configured to receive a driving force and to contact the particular surface of the sheet, and a pinch roller disposed below the re-conveying path, wherein the driving roller has a greater coefficient of friction than the pinch roller; and a particular conveyance member configured to support the pinch roller, wherein the particular conveyance member comprises:

a guide rib extending along the conveying direction; and a downstream end portion disposed at a downstream end of the particular conveyance member in the conveying direction, the downstream end portion inclined in a width direction perpendicular to the conveying direction.

8. The image forming device according to claim 7, further comprising a re-conveying unit that comprises a single regulation member extending in a particular direction and configured to contact a particular end of the sheet to regulate a position of the sheet, wherein the pinch roller is disposed at a particular angle relative to the driving roller in a direction perpendicular to the particular direction.

9. The image forming device according to claim 8, wherein the conveyor roller set is disposed closer to the single side regulation member than to a center of the re-conveying unit in the direction perpendicular to the particular direction.

10. The image forming device according to claim 7, wherein the driving roller comprises rubber and the pinch roller comprises plastic material.

11. The image forming device according to claim 7, wherein the pinch roller is disposed further from the sheet container unit than the driving roller.

12. The image forming device according to claim 7, further comprising a re-conveying unit that comprises a plurality of further conveyor roller sets configured to convey the sheet therebetween, wherein each of the plurality of the further conveyor roller sets comprises:

a further driving roller disposed above the re-conveying path and configured to receive a driving force, and a further pinch roller.

13. An image forming device comprising:

a sheet container unit configured to store a plurality of sheets;

an image forming unit configured to form an image on a particular surface of a sheet that is conveyed from the sheet container unit; and a conveyor roller set configured to convey the sheet with the image formed on the particular surface on a re-conveying path in a conveying direction, wherein the conveyor roller set comprises:

a driving roller configured to receive a driving force and to contact the particular surface of the sheet, and a pinch roller disposed further from the image forming unit than the driving roller, wherein the driving roller has a greater coefficient of friction than the pinch roller; and a particular conveyance member configured to support the pinch roller, wherein the particular conveyance member comprises:

a guide rib extending along the conveying direction; and a downstream end portion disposed at a downstream end of the particular conveyance member in the conveying direction, the downstream end portion inclined in a width direction perpendicular to the conveying direction.

14. The image forming device according to claim 13, further comprising a re-conveying unit that comprises a single regulation member extending in a particular direction and configured to contact a particular end of the sheet to regulate a position of the sheet, wherein the pinch roller is disposed at a particular angle relative to the driving roller in a direction perpendicular to the particular direction.

15. The image forming device according to claim 14, wherein the conveyor roller set is disposed closer to the single side regulation member than to a center of the re-conveying unit in the direction perpendicular to the particular direction.

16. The image forming device according to claim 14, wherein the particular conveyance member further comprises a first side and a second side, the first side and the second side extending in substantially the conveying direction, wherein the pinch roller comprises a first portion and a second portion, the first portion of the pinch roller disposed closer than the second portion of the pinch roller to the first side of the particular conveyance member, and the second portion of the pinch roller disposed closer than the first portion of the pinch roller to the second side of the particular conveyance member, wherein the first portion of the pinch roller is disposed further downstream in the conveying direction than the second portion of the pinch roller, wherein the downstream end portion comprises a first portion and a second portion, the first portion of the downstream end portion disposed closer than the second portion of the downstream end portion to the first side of the particular conveyance member, and the second portion of the downstream end portion disposed closer than the downstream end portion of the pinch roller to the second side of the particular conveyance member, and wherein the second portion of the downstream end portion is disposed further downstream in the conveying direction than the first portion of the downstream end portion.

17. The image forming device according to claim 13, wherein the driving roller comprises rubber and the pinch roller comprises plastic material.

18. The image forming device according to claim 13, wherein the pinch roller is disposed further from the sheet container unit than the driving roller.

19. The image forming device according to claim 13, further comprising a re-conveying unit that comprises a plurality of further conveyor roller sets configured to convey the sheet therebetween, each of the plurality of the further conveyor roller sets comprising:

a further driving roller configured to receive a driving force, and a further pinch roller disposed further from the image forming unit than the driving roller.

20. The image forming device according to claim 13, wherein the sheet container unit is further configured to be removable from the image forming device, the sheet container unit comprising:

a downstream path forming portion disposed in a lower portion of the sheet container unit; and an upstream end portion inclined in the width direction perpendicular to the conveying direction, wherein the upstream end portion is connected to the downstream end portion.

* * * * *